US006840170B2

(12) United States Patent
Becker et al.

(10) Patent No.: US 6,840,170 B2
(45) Date of Patent: Jan. 11, 2005

(54) DEVICE FOR TORQUE COMPENSATION IN A SHEET-PROCESSING MACHINE AND REVERSING DRUM HAVING A TORQUE COMPENSATION DEVICE

(75) Inventors: Willi Becker, Bammental (DE); Daniel Conzelmann, Dielheim (DE); Andreas Fricke, Eberbach (DE); Gerhard Heppenstiel, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/457,860

(22) Filed: Jun. 10, 2003

(65) Prior Publication Data

US 2003/0226458 A1 Dec. 11, 2003

(30) Foreign Application Priority Data

Jun. 10, 2002 (DE) ..... 102 25 538

(51) Int. Cl.[7] ..... B41F 5/00

(52) U.S. Cl. ..... 101/216; 101/223; 101/230; 101/484; 74/53; 74/54; 74/55; 74/569

(58) Field of Search ..... 101/222, 223, 101/230, 484, 216, 217; 74/53, 54, 55, 56, 569

(56) References Cited

U.S. PATENT DOCUMENTS 4,385,649 A * 5/1983 Sevcik ..... 139/435.3
4,854,236 A 8/1989 Thünker et al.
5,076,165 A * 12/1991 Pollich ..... 101/409
5,456,128 A * 10/1995 Thunker ..... 74/53
5,544,537 A * 8/1996 Konzal ..... 74/53
6,000,298 A * 12/1999 Kato ..... 74/569
6,073,503 A * 6/2000 Matsuno et al. ..... 74/55
6,401,620 B1 * 6/2002 Buck et al. ..... 101/484
6,467,374 B1 * 10/2002 Kaplun ..... 74/640
6,619,201 B1 * 9/2003 Becker et al. ..... 101/230

FOREIGN PATENT DOCUMENTS

| | | |
|---|---|---|
| DE | 2 022 245 | 11/1970 |
| DE | 38 23 545 A1 | 2/1989 |
| DE | 41 09 409 C2 | 10/1991 |
| DE | 100 40 951 A1 | 3/2001 |
| DE | 101 11 070 A1 | 10/2001 |
| EP | 0 254 897 B1 | 2/1988 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A device for torque compensation in a sheet-processing machine includes a cam-controlled compensating mechanism having an energy storage device for exerting a force, a cam disk, and a cam follower to be thrown onto the cam disk by action of the force from the energy storage device. At least one actuating element locks the cam follower in a rest position. A reversing drum with a torque compensation device is also provided.

10 Claims, 3 Drawing Sheets

35
38
39
40
41
42
43
44
50
51
52
53
54
55
56
57
58
59
61
62
63
Solenoid Valve
Control Computer

DEVICE FOR TORQUE COMPENSATION IN A SHEET-PROCESSING MACHINE AND REVERSING DRUM HAVING A TORQUE COMPENSATION DEVICE

BACKGROUND OF THE INVENTION

Field of the Invention

The invention relates to a device for torque compensation in a sheet-processing machine, in particular a rotary printing press, and a reversing drum having a torque compensation device.

In sheet-processing machines, in particular rotary printing presses, there arises a problem that periodically accelerated gripper systems cause varying drive torques, which produce rotational vibrations and, for example, lead to a reduction in print quality.

German Published, Non-prosecuted Patent Application DE 41 09 409 A1, for example, discloses a cam-controlled power-compensating mechanism for compensating for the torques which act upon the control cam and which are produced by the inherent mass of a vibrating pregripper. That is done with the aid of at least one element acting directly on the control cam.

The mechanism described in the foregoing German patent application has a disadvantage in that it is continuously in operation and cannot be adapted to different operating states.

SUMMARY OF THE INVENTION

It is accordingly an object of the invention to provide a device for torque compensation in a sheet-processing machine and a reversing drum having a torque compensation device, which overcome the hereinafore-mentioned disadvantages of the heretofore-known devices of this general type and which, for example, can also be used on a reversible turning or reversing device in a sheet-processing machine.

With the foregoing and other objects in view, there is provided, in accordance with the invention, a device for torque compensation in a sheet-processing machine, in particular a rotary press. The device comprises a cam-controlled compensating mechanism for throwing a cam follower onto a cam disk subject to an action of a force from an energy storage device. At least one actuating element is provided for locking the cam follower in a rest position.

In accordance with another feature of the invention, the actuating element is a swivelably disposed cam segment.

In accordance with a further feature of the invention, the actuating element is a movable pawl.

In accordance with an added feature of the invention, the cam disk has high and low points. The cam segment has high and low points at least approximately corresponding to the high and low points of the cam disk.

In accordance with an additional feature of the invention, the torque compensation device further includes another actuating element. The actuating elements are disposed so as to be actuatable independently of one another.

In accordance with yet another feature of the invention, there is provided another compensating mechanism and another cam segment. Each of the cam segments is operatively connected to a respective one of the compensating mechanisms.

In accordance with yet a further feature of the invention, the energy storage device of the compensating mechanism is adjustably braced stationarily.

In accordance with yet an added feature of the invention, the torque compensation device further includes a control computer for adjusting the energy storage device.

In accordance with yet an additional feature of the invention, the actuating elements have respective actuators therefor which are switchable under computer control.

With the objects of the invention in view, there is also provided a reversing drum in a sheet-processing machine, in particular a rotary press, comprising a torque compensation device including a cam-controlled compensating mechanism for throwing a cam follower onto a cam disk subject to an action of a force from an energy storage device. At least one actuating element is provided for locking the cam follower in a rest position.

One advantage of the invention resides, in particular, in that the torque compensation device is switchable into an operating position and from the operating position into a rest position. Due to this measure, an application to a reversing or turning drum in a rotary printing press is possible. The latter operates on one hand in a single-side or recto printing operation and on the other hand in a first-form and perfecting recto/verso operation.

A further advantage is the configuration of a swivelable cam segment serving as an actuating member and, in order to be thrown off gently, being actuatable both when the printing press or processing machine is stationary and during a rotation of the reversing drum.

In an alternative configuration of the actuating member, provision is made for the actuating member to be in the form of a pawl.

An advantageous development provides for the configuration of two torque compensating devices, which are switchable independently of one another in order to cover a greater rotational speed range.

A further advantageous refinement provides for the energy storage device or devices of the compensating mechanism to be adjustable under computer control, so that they can always be adapted to the rotational speed of the printing press or processing machine.

Other features which are considered as characteristic for the invention are set forth in the appended claims.

Although the invention is illustrated and described herein as embodied in a device for torque compensation in a sheet-processing machine and a reversing drum having a torque compensation device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
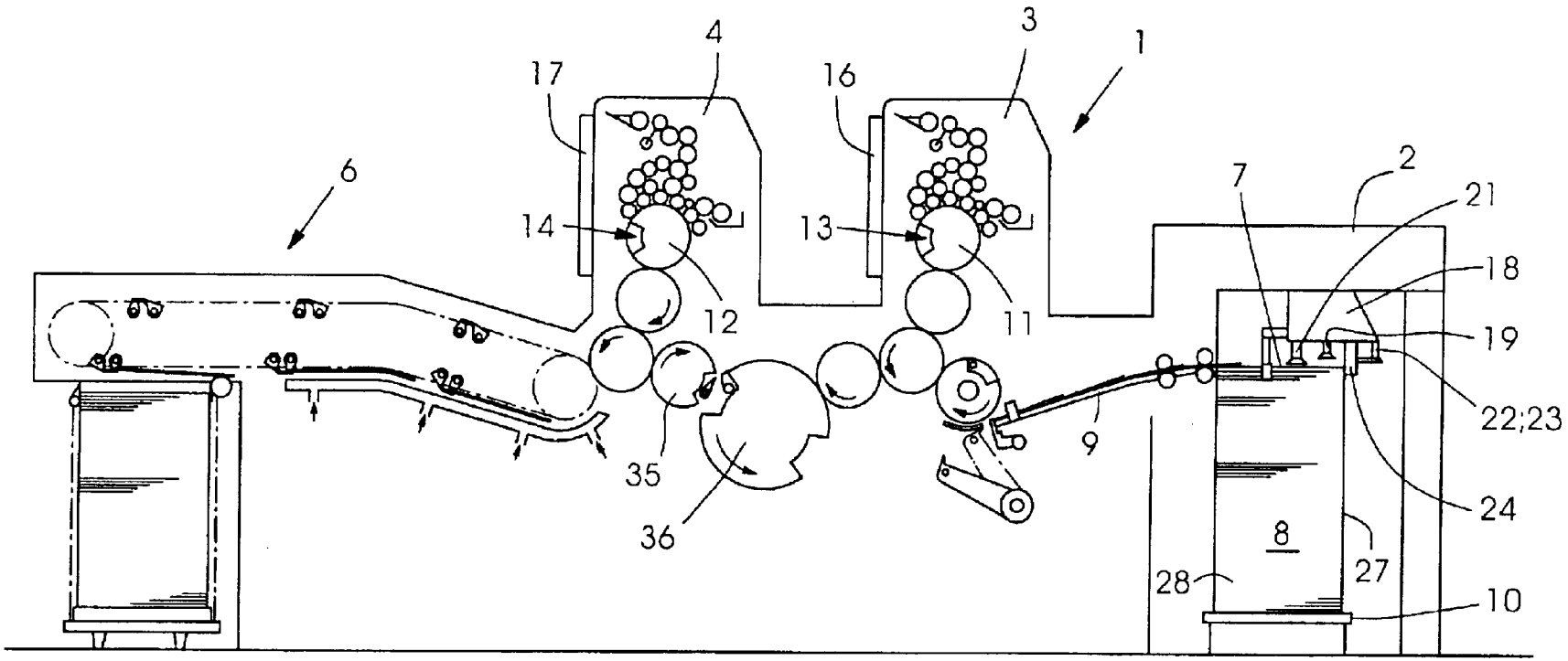
FIG. 1 is a diagrammatic, side-elevational view of a rotary printing press provided with a torque-compensating control according to the invention.

Referring now to the figures of the drawings in detail and first, particularly, to FIG. 1 thereof, there is seen a rotary printing press, for example a printing press for processing sheets 7, which has a feeder 2, at least one printing unit 3, 4, two of which are shown, and a delivery 6. The sheets 7 are removed from a sheet pile or stack 8 and are fed, singly separated or in overlapping or imbricated formation, over a feed table 9 to the respective printing units 3 and 4. The printing units 3, 4 have respective plate cylinders 11, 12 disposed therein in a conventional manner. The plate cylinders 11, 12 have respective devices 13, 14 for fastening flexible printing plates. Furthermore, each plate cylinder 11, 12 has a device 16, 17 assigned thereto for semi-automatically or fully automatically performing an exchange of printing plates.

The sheet pile 8 lies on a controllingly liftable pile board 10. The sheets 7 are removed from the top of the sheet pile 8 by a so-called suction head 18 which has, among other elements, a number of lifting and dragging or pull suckers 19, 21 for separating or singling the sheets 7. Furthermore, a blast or blowing device 22 for loosening the top layers of the sheets 7, and scanning elements 23 for tracking the sheet pile 8, are provided. A number of lateral and rear stops 24 are provided in order to align the sheet pile 8 and, in particular, the top sheets 7 of the sheet pile 8.

Figure 2:
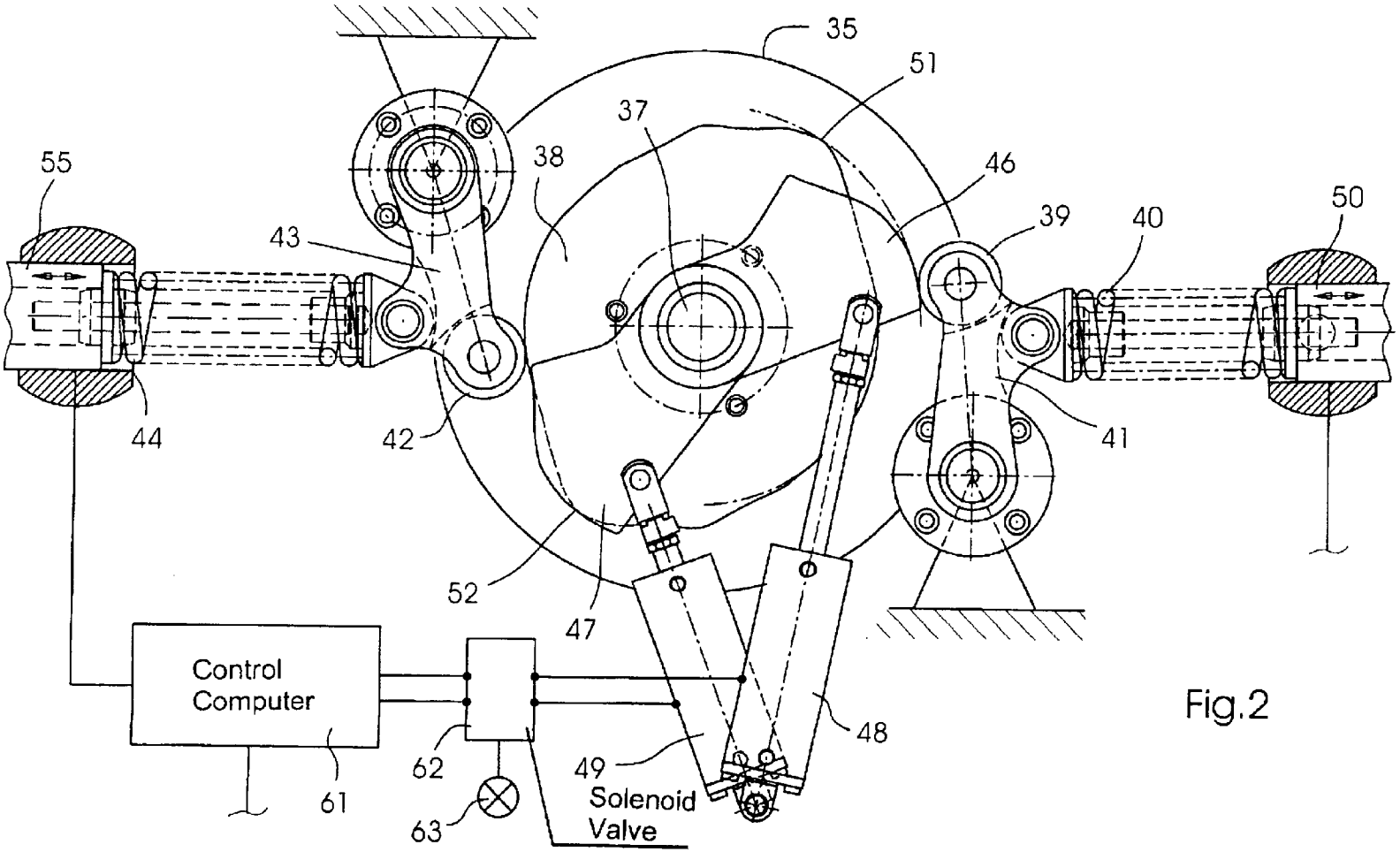
FIG. 2 is an enlarged, fragmentary, side-elevational view of a portion of FIG. 1, showing in greater detail the reversing drum thereof with the torque-compensating control device according to the invention.

A reversing or turning device disposed between the two printing units 3 and 4 has a reversing or turning drum 35, which can be converted from recto or single-side printing to recto/verso or first-form and perfector printing. The reversing drum 35 is equipped with a device for torque compensation, which is illustrated in detail in FIG. 2. This torque compensation device has a cam disk 38 which is disposed on a journal 37 of the reversing drum 35 and rotates synchronously with the reversing drum 35. During the reversing or turning operation with the activated device for torque compensation, a first cam roller or cam follower 39 is in operative contact with the cam disk 38. The cam roller 39 is disposed at the end of a first roller lever 41 which, at an end thereof facing away from the cam roller 39, is swivelably mounted on a side frame of the printing press. A force-storing device braced against the side frame, for example in the form of a compression spring 40, acts upon the roller lever 41 and presses the cam roller 39 into operative contact with the cam disk 38.

A second cam roller or cam follower 42, which is offset by about 180° from the first cam roller 39, is disposed at the end of a second roller lever 43. The second roller lever 43 has an end thereof facing away from the cam roller 42 which is swivelably mounted on the frame of the printing press.

Another force-storing device fixedly braced against the frame, for example in the form of a compression spring 44, acts upon the roller lever 43 and presses the second cam roller 42 into operative contact with the cam disk 38. The cam disk 38 has a cam profile selected in such a way that the respective force-storing device or spring 40, 44 at all times experiences a change in potential, via the respective roller lever 41, 43, which corresponds to the drive torque of the mechanisms of the reversing drum to be compensated for in the first-form and perfecting operating state at a specific machine speed.

Since this compensating torque is not required in the recto or single-side printing state of operation, in order to throw the respective cam roller 39, 42 off the cam disk 38, a respective cam segment 46, 47 is provided, which is disposed on the journal 37 of the reversing drum 35 or swivelable on the frame. The cam segments 46 and 47 are respectively actuatable by an actuator, for example a respective pneumatic cylinder 48, 49, which is fixedly supported on the frame. The cam disk 38 has two diametrically opposite high points 51 and 52 at which the respective roller levers 41 and 43 experience the greatest deflection thereof by the respective cam rollers 39 and 42. The cam segments 46 and 47 are respectively matched to the contour of the cam disk 38 in the region of the respective high points 51 and 52 and the low points thereof. Due to this measure, the respective cam rollers 39 and 42 can be thrown on and off the cam disk 38 both when the reversing drum 32 is stationary and when it is rotating. The high point of the respective cam segments 46 and 47 is minimally higher than the high point of the cam disk 38.

When the machine is converted to the single-side or recto printing operating state, the actuator swivels the respective cam segment 47, 48 until it has lifted the respective broadened compensating cam roller 39, 42 above the respective high point 51, 52 of the cam disk 38. Contact between the respective cam roller 39, 42 and cam disk 38 is therefore broken or released, so that no compensating torque is fed in.

If the respective cam roller 39, 42 is to be lifted off the cam disk 38, then, due to the outward movement of the respective pneumatic cylinder 48, 49, the cam segment 46 is swiveled in counterclockwise direction out of a latching position, or in the case of the cam segment 47, is swiveled in clockwise direction until the respective cam rollers 39 and 42 have been lifted a slight extent above the respective high point 51, 52 of the cam disk 38.

In order to throw the respective cam rollers 39 and 42 on from this position, the cam segment 46 is swiveled in the clockwise direction, and the cam segment 47 in the counterclockwise direction. In this regard, the respective cam roller 39, 42 rolls on the contour of the respective cam segment 46, 47 until it rests on the cam disk 38.

The respective roller levers 41 and 43 could also be thrown on and off by other non-illustrated actuating elements, for example via pneumatic or hydraulic cylinders directly on the roller levers and pawls, respectively, which prevent the swiveling movement, or motor-driven threaded spindles or actuating eccentrics.

By using two torque compensating devices 39, 40 and 42, 44, respectively, which can be driven independently of one another, it is possible for them to be activated after one another and thereby widen or broaden the rotational speed range within which compensation can be provided. For precisely adjusting the compensating mechanism to different rotational speeds, provision is additionally made for forming the energy storage devices 40 and 44, respectively, so that they are adjustable with respect to the amount of the energy (force). A control computer 61 is connected to the respective adjusting device 50, 55, for example pneumatic cylinders or actuating motors, for the respective energy storage devices 40 and 44, and displaces the respective energy storage devices 40 and 44 automatically with the aid of determined or prescribed parameters, such as the rotational speed of the press, for example.

Figure 3:
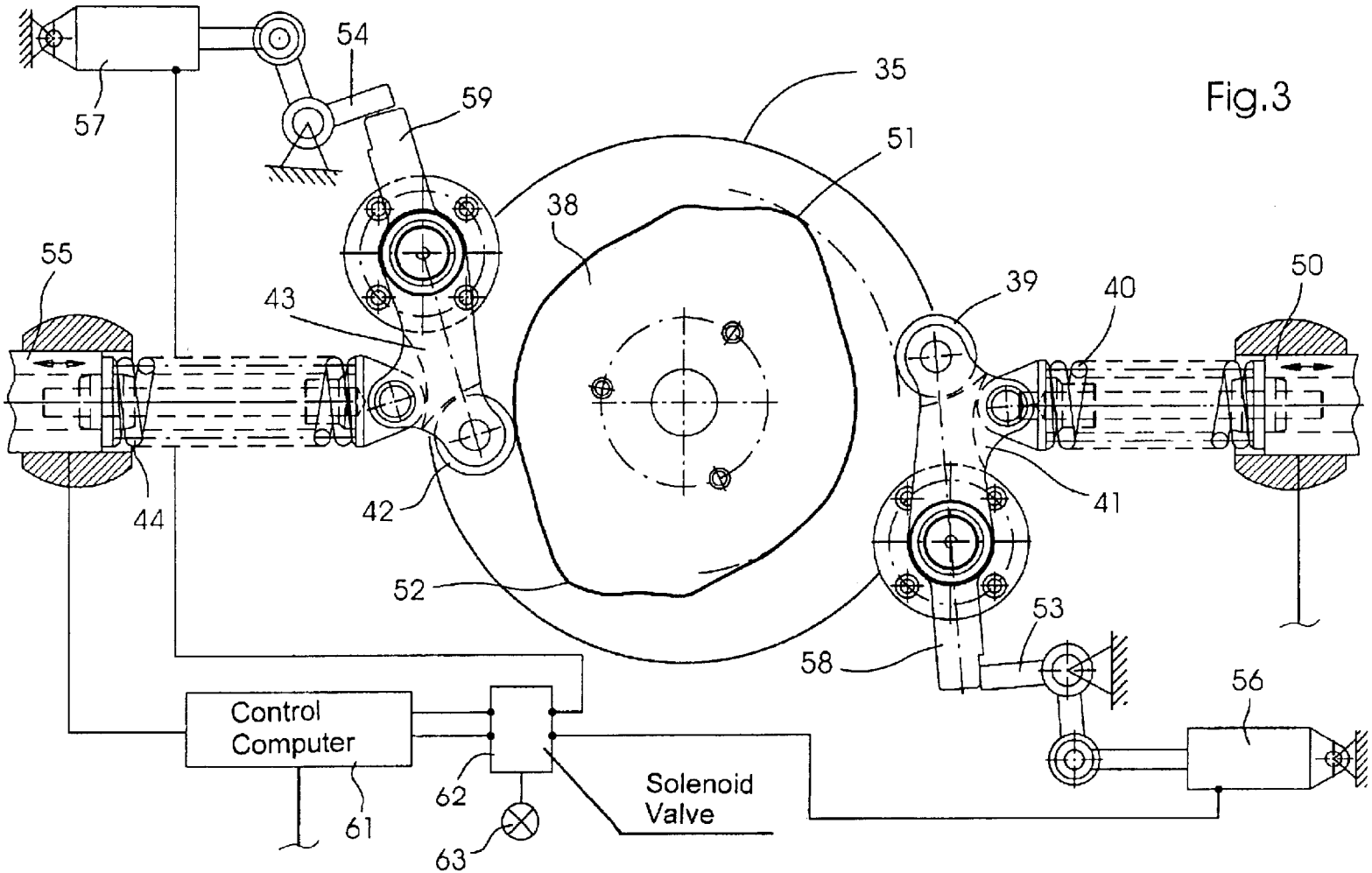
FIG. 3 is a view similar to that of FIG. 2, showing another exemplary embodiment of the torque-control device according to the invention.

A second exemplary embodiment is shown in FIG. 3. In order to hold the compensating mechanism in a rest position, in this regard, a respective pawl 53, 54 is provided, which is swivelably mounted on the printing-press and, by suitably provided actuators 56 and 57, respectively, is switchable into and out of a latching position with a respective part 58, 59 of the compensating mechanism. The respective actuators

56 and 57 are controllingly drivable programmably by a control computer 61. In the exemplary embodiments of FIGS. 2 and 3, the actuators are formed as pneumatic cylinders, which are switchable via computer-controlled electromagnetic or solenoid valves 62 with a pressure source 63.

We claim:

1. A torque compensation device in a sheet-processing machine, the device comprising:

a cam-controlled compensating mechanism including an energy storage device for exerting a force, a cam disk, and a cam follower to be thrown onto said cam disk by action of said force from said energy storage device; and at least one actuating element for locking said cam follower in a rest position in a first-form printing operation.

2. The torque compensation device according to claim 1, wherein said at least one actuating element is a swiveling cam segment.

3. The torque compensation device according to claim 1, wherein said actuating element is a movable pawl.

4. The torque compensation device according to claim 2, wherein said cam disk has high and low points, and said cam segment has high and low points at least approximately corresponding to said high and low points of said cam disk.

5. The torque compensation device according to claim 1, wherein said at least one actuating element includes two actuating elements being actuatable independently of one another.

6. The torque compensation device according to claim 4, further comprising another compensating mechanism, and another cam segment, each of said cam segments being operatively connected to a respective one of said compensating mechanisms.

7. The torque compensation device according to claim 1, wherein said energy storage device of said compensating mechanism is adjustably braced stationarily.

8. The torque compensation device according to claim 7, further comprising a control computer for adjusting said energy storage device.

9. The torque compensation device according to claim 5, wherein said actuating elements have respective actuators to be switched under computer control.

10. A reversing drum in a sheet-processing machine, comprising a torque compensation device including:

a cam-controlled compensating mechanism having an energy storage device for exerting a force, a cam disk, and a cam follower to be thrown onto said cam disk by action of said force from said energy storage device; and at least one actuating element for locking said cam follower in a rest position in a first-form printing operation.

* * * * *